US007628747B2

(12) United States Patent
Kocherga et al.

(10) Patent No.: US 7,628,747 B2
(45) Date of Patent: Dec. 8, 2009

(54) METHOD AND APPARATUS FOR FORMING CORRUGATED BOARD CARTON BLANKS

(76) Inventors: Michael E. Kocherga, 1579-A Jayken Way, Chula Vista, CA (US) 91911; Alejandro Gonzalez, Blv. Manuel Avila Camacho, No. 36-Torre Esmeralda, No. 2-Piso 21 Colonia Lomas de Chapultepec, Mexico, Distrito Federal (MX) 11100

( * ) Notice: Subject to any disclaimer, the term of this patent is extended or adjusted under 35 U.S.C. 154(b) by 0 days.

(21) Appl. No.: 12/006,847

(22) Filed: Jan. 7, 2008

(65) Prior Publication Data

US 2008/0108490 A1 May 8, 2008

Related U.S. Application Data

(62) Division of application No. 10/981,217, filed on Nov. 4, 2004, now Pat. No. 7,326,168.

(60) Provisional application No. 60/554,886, filed on Mar. 19, 2004.

(51) Int. Cl.
*B31B 1/25* (2006.01)

(52) U.S. Cl. ..... 493/59; 493/463; 493/150

(58) Field of Classification Search ..... 493/59, 493/79, 463, 480, 150, 131, 11, 34
See application file for complete search history.

(56) References Cited

U.S. PATENT DOCUMENTS

| | | | |
|---|---|---|---|
| 1,199,508 | A | 9/1916 | Swift, Jr. |
| 1,591,062 | A | 7/1926 | Smith |
| 1,609,320 | A | 12/1926 | Smith |
| 3,239,676 | A | 3/1966 | Pali |
| 4,268,341 | A | 5/1981 | Huhne |
| 5,993,587 | A | 11/1999 | Seki et al. |
| 6,106,448 | A | 8/2000 | Obara et al. |
| 6,129,654 | A | 10/2000 | Mosburger |
| 6,136,417 | A | 10/2000 | Ishibuchi et al. |
| 6,454,689 | B1 | 9/2002 | Voss |
| 6,910,996 | B1 | 6/2005 | Patz |
| 6,913,570 | B2 | 7/2005 | Kehrle |
| 6,935,998 | B2 | 8/2005 | Silvestre |

*Primary Examiner*—Sameh H. Tawfik
(74) *Attorney, Agent, or Firm*—John D. Lister

(57) ABSTRACT

An in-line method and apparatus for making a corrugated board and carton blanks from the corrugated board include: a laminating station for completing the formation of a corrugated board having a corrugated medium, an inner liner, and a printed outer liner; an adhesive setting station for curing adhesive in the corrugated board; and a creasing, cutting, and scrap removal station for repeatedly forming sets of fold lines and cuts in the corrugated board to make carton blanks. The sets of fold lines and cuts may be formed by rotary or flatbed dies and a control system properly locates the sets of fold lines and cuts and printed matter on the outer liner relative to each other on the carton blanks being formed.

5 Claims, 4 Drawing Sheets

METHOD AND APPARATUS FOR FORMING CORRUGATED BOARD CARTON BLANKS

This application is a division of application Ser. No. 10/981,217, filed Nov. 4, 2004 now U.S. Pat. No. 7,326,168.

This patent application claims priority to provisional patent application No. 60/554,886, filed Mar. 19, 2004, the disclosure of which is incorporated herein by reference.

BACKGROUND OF THE INVENTION

The subject invention relates to a method and apparatus for forming corrugated board carton blanks in a process wherein corrugated board is formed and die creased and cut into corrugated board carton blanks in a single in-line process.

Cartons for containing bottled products such as but not limited to beer and other beverages and for containing other relatively heavy products are commonly made from corrugated board carton blanks wherein the major surfaces of the corrugated board carton blanks that become the external surfaces of the cartons have printed matter and/or markings thereon such as trademarks, logos, instructions, and other information. Corrugated board beverage cartons and other corrugated board shipping cartons made from such corrugated board carton blanks have the required integrity to contain the weight of such products and cushion such products from external impacts that occur during shipping and handling. Corrugated board shipping cartons are used for packaging product in virtually every industry in the United States and currently account for the largest percentage of shipping containers used in the packaging container business. In addition to being used for shipping cartons, corrugated board is also used for the bracing and blocking of cartons, for partitions within cartons that hold products, e.g. beverage bottles, in place and apart from each other, for cushions between layers of products within cartons and for cushioning heavy products within cartons.

The current practice for making such corrugated board carton blanks, which has been in place for decades, involves a series of separate and individual process steps. In a first in-line process step, an outer liner with printed matter and/or markings thereon, such as trademarks, logos, instructions, and other information, is laminated to a corrugated board having a corrugated medium and an inner liner to form a corrugated board with an outer liner and an inner liner. The corrugated board is then cut into flat rectangular sheets and stacked. In a separate second off-line process step, the flat rectangular sheets of corrugated board are allowed to stand for a predetermined dwell time while the adhesive bonding the outer and inner liners to the corrugated medium sets so that the flat rectangular sheets of corrugated board will have the necessary integrity to undergo the stresses of die-cutting. In a separate third off-line process step, the flat rectangular sheets of corrugated board that are produced in the first and second process steps are individually converted to carton blanks in a die creasing and cutting operation. Where the die-cutter of the die creasing and cutting operation is not provided with full stripping capabilities for automatically removing trim and other pieces of scrap from the blanks being formed, trim and other pieces of scrap are subsequently removed from the corrugated board carton blanks in a separate fourth off-line process step.

As stated above, in the die creasing and cutting process, the corrugated board, made in the first and second separate process steps, is subjected to stresses caused by the creasing and cutting of the corrugated board by the ceasing and cutting die. If the adhesive bonds between the inner and outer liners and the corrugated medium of the corrugated board lack sufficient integrity, one or both of the liners of the corrugated board can be shifted relative to or separated from the corrugated medium during the creasing and cutting process. To be commercially competitive, the corrugated board must be made on the first production line at speeds of hundreds of feet per minute (e.g. 600 feet per minute) and on current production lines, this does not allow the adhesive bonding the inner and outer liners to the corrugated medium of the corrugated board to set up sufficiently to withstand the stresses the corrugated board will undergo during the creasing and cutting operation without a possible displacement of one or both of the liners relative to or separation of one or both of the liners from the corrugated medium. The displacement or separation of one or both of the liners from the corrugated medium of the carton blanks being produced would adversely affect the integrity of the corrugated board carton blanks and the cartons made from the carton blanks. The displacement or separation of the outer liner with the printed matter and/or markings thereon that is to become the exterior surface of the cartons made from the corrugated board blanks can cause the printed matter and/or markings on the corrugated board to be out of register in the creasing and cutting operation so that the creases and cuts formed in the corrugated board and the printed matter and/or markings on the corrugated board are not properly located relative to each other on the corrugated board carton blanks or the cartons formed from the carton blanks. By using the off-line second process step currently employed in the industry to permit the adhesive to set prior to introducing the sheets of corrugated board into the die creasing and cutting operation, the adhesive bonding the liners to the corrugated medium can be allowed to set and form a good bond between the liners and the corrugated medium so that the corrugated board has sufficient integrity to withstand the creasing and cutting operation that forms the corrugated board into carton blanks.

When making carton blanks from a corrugated board, the printed matter and/or markings on the outer liner of the corrugated board that forms the outer surface of the carton erected from the carton blank must be precisely located relative to the creases and cuts made in the corrugated board during the die creasing and cutting operation so that the printed matter and/or markings are properly located on the carton blanks. With the speed that the corrugated board passes through the first process for forming the corrugated board and the need for the precision formation of the creases and cuts in the corrugated board relative to the printed matter and/or markings on the outer liner of the corrugated board, it is again current practice in the industry, which has been in place for decades, to perform the die creasing and cutting operation in the off-line process discussed above.

While the corrugated board carton blanks formed through the use of current industry practices are well made, the need to have a series of separate processes where the corrugated board is first laminated in one process, the adhesive bonding the layers of the corrugated board together is allowed to set in a second off-line process, and then the die creasing and cutting is performed in a third off-line process increases product handling, increases labor costs, requires the storage of the flat rectangular sheets of corrugated board between the first and third process steps, and requires the maintenance of two separate process lines. The method and apparatus of the subject invention solve the problems associated with current industry practices by providing an efficient, cost effective, high output method and apparatus for forming corrugated board carton blanks wherein a corrugated board is formed, adhesive of the corrugated board is set, and the corrugated board is die creased, cut, and stripped of waste to form finished corrugated board carton blanks in a single in-line operation.

SUMMARY OF THE INVENTION

In the apparatus and method of the subject invention for forming corrugated board carton blanks, corrugated board is formed, the adhesive bonding the layers of the corrugated board together is set, and the corrugated board is die creased, cut, and stripped to form finished corrugated board carton blanks on an in-line process. The corrugated board formed by the apparatus and method of the subject invention is a laminate that includes an printed outer liner, an inner liner, and a corrugated medium intermediate the printed outer liner and the inner liner. The liners of the corrugated board may each be made of a single paperboard or paperboard-based sheet material or laminates of two or more paperboard or paperboard-based sheet materials and a corrugated board may have two or more corrugated medium layers and additional liner(s) intermediate the corrugated medium layers, e.g. a corrugated board with two corrugated medium layers, an printed outer liner, an inner liner, and a liner intermediate the two corrugated medium layers.

In the in-line process of the subject invention, a corrugated board without a printed outer liner is produced on an upstream portion of the corrugated board carton blank production line. The upstream portion of the corrugated board carton blank production line that produces this corrugated board may be conventional. The corrugated board from the upstream portion of the production line is typically fed, at production line speeds (e.g. speeds of several hundred to 600 or more feet per minute), into the downstream portion of the production line that includes the apparatus of subject invention for forming corrugated board carton blanks by the method of the subject invention. In the apparatus and method of the subject invention, a printed outer liner is laminated onto the corrugated board being fed from the upstream portion of the production line to form a corrugated board that has a printed outer liner, an inner liner and a corrugated medium layer. Typically, the printed matter on the exposed surface of the printed outer liner of the corrugated board is marketing, regulatory, and other commercially significant information such as company logos, product trademarks, bar codes, instructions, and other product or company related information. In addition, the exposed surface of the printed outer liner of the corrugated board has a series of registration marks thereon that are used by a control system in a downstream creasing and cutting station of the process to accurately locate the printed outer liner relative to the creasing and cutting dies or creasing and cutting die of the creasing and cutting station so that the sets of fold lines and sets of cuts formed in the creasing and cutting station along with the information printed on the printed outer liner are properly located on the corrugated board carton blanks formed in the in-line process.

The printed outer liner of the corrugated board is adhesively bonded to a corrugated medium layer of the corrugated board fed from the upstream portion of the production line to form the corrugated board. By the time the corrugated board thus formed is introduced into the creasing and cutting station of the process, the corrugated board must have sufficient integrity to withstand the die creasing and cutting operations of the creasing and cutting station. Accordingly, in the method of the subject invention, the adhesive bonding the printed outer liner to the corrugated medium of corrugated board is set (e.g. dried or cured) at least to the extent required to provide the corrugated board with the required integrity to undergo the die creasing and cutting operation before the corrugated board in introduced into the creasing and cutting station. While the corrugated board may be passed through one or more drying ovens to set the adhesive (e.g. a conventional adhesive normally used in the manufacture of corrugated board) sufficiently to provide the corrugated board with the required integrity for the die creasing and cutting operation, it is also contemplated that fast setting, drying, or curing adhesives might be used to bond the printed outer liner to the corrugated medium layer of the corrugated board that could eliminate the need for the oven(s).

In the creasing and cutting station of the in-line process, the corrugated board is creased and cut to form corrugated board carton blanks, e.g. such as but not limited to the corrugated board carton blanks used to form the bottle containing cartons that contain twenty four-twelve ounce bottles or twelve-twelve ounce bottles of beer. In a preferred apparatus of the subject invention, the creasing and cutting operation of the creasing and cutting station includes a rotary die creaser and a rotary die cutter. Preferably, the corrugated board is creased to form fold lines in the board as the corrugated board passes through the first or upstream rotary die creaser. Then, the previously creased double-faced corrugated board is cut and scrap is automatically removed (e.g. by conventional stripping techniques) as the corrugated board passes through the second or downstream rotary die cutter to complete the formation of the corrugated board carton blanks.

The locations of the registration marks on the exposed surface of the printed outer liner of the corrugated board relative to an optimum location for the registration marks are monitored by process controls as the corrugated board passes through the creasing and cutting station to assure that the creasing and cutting operations of the first and second rotary dies of the station are properly coordinated to place the creases and cuts in the right locations relative to each other on the corrugated board and to form corrugated board carton blanks with the printed matter properly located on the corrugated board carton blanks. When the process controls detect that the registration marks on the corrugated board are approaching or at a preselected upstream or downstream distance from the preselected optimum location for properly locating the corrugated board relative to one or both of the rotary dies in the station, the positions of one or both of the rotary dies of the station are adjusted relative to the corrugated board passing through the station to bring the corrugated board back into proper registration with the rotary dies. In a preferred apparatus of the subject invention, this is accomplished by moving one or both of the rotary dies in an upstream or a downstream direction of the production line. Where the positions of both rotary dies are adjusted, the positions of the rotary dies could be adjusted in the same or opposite directions.

It is also contemplated, that a single rotary die could perform the creasing and cutting of the corrugated board to form the corrugated board carton blanks or that a single flatbed die could be used to form the corrugated board carton blanks. In this situation, the registration marks would be used in a similar manner to keep the corrugated board in proper registration with the single rotary die or single flatbed die. Whether the carton blanks are formed using two rotary dies, a single rotary die, or a single flatbed die, the corrugated board is maintained in a sufficiently planar state throughout the in-line manufacturing process to cause the carton blanks formed by the method to be flat (planar or substantially planar).

After the corrugated board carton blanks have been formed by the method or apparatus of the subject invention, the corrugated board carton blanks are ready to be folded and glued to form cartons or packaged flat for shipment to a packaging operation.

DESCRIPTION OF THE PREFERRED EMBODIMENTS

Figure 1:
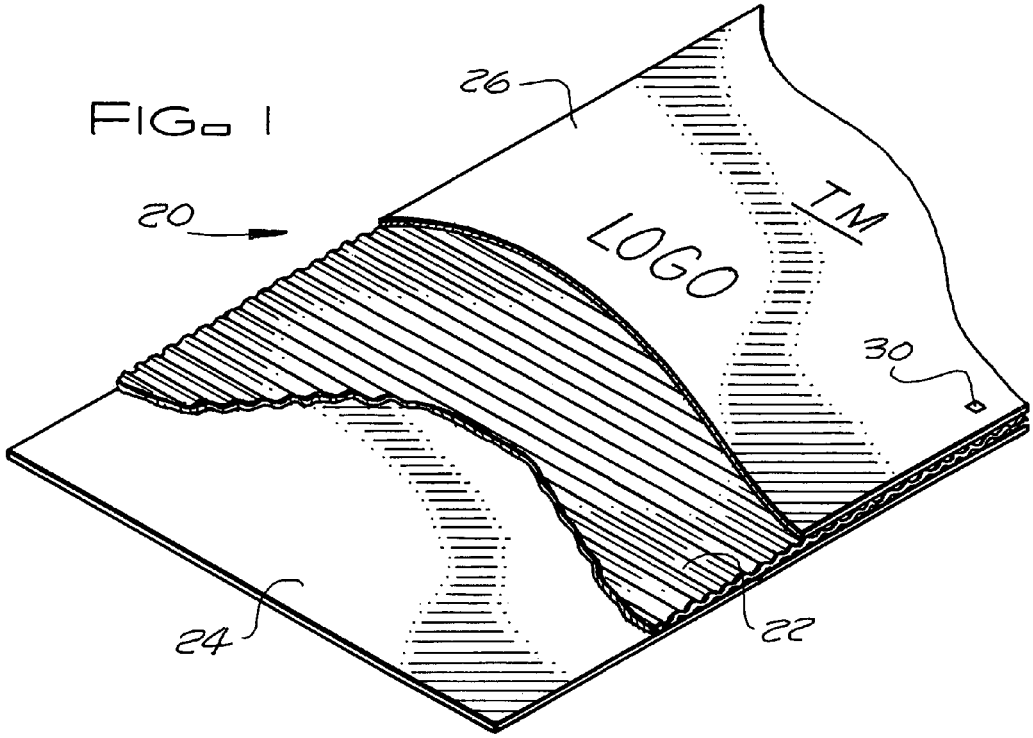
FIG. 1 is a schematic perspective view, with portions broken away, of a typical corrugated board used in the method of the subject invention to form corrugated board carton blanks on an in-line production line of the subject invention.
Figure 2:
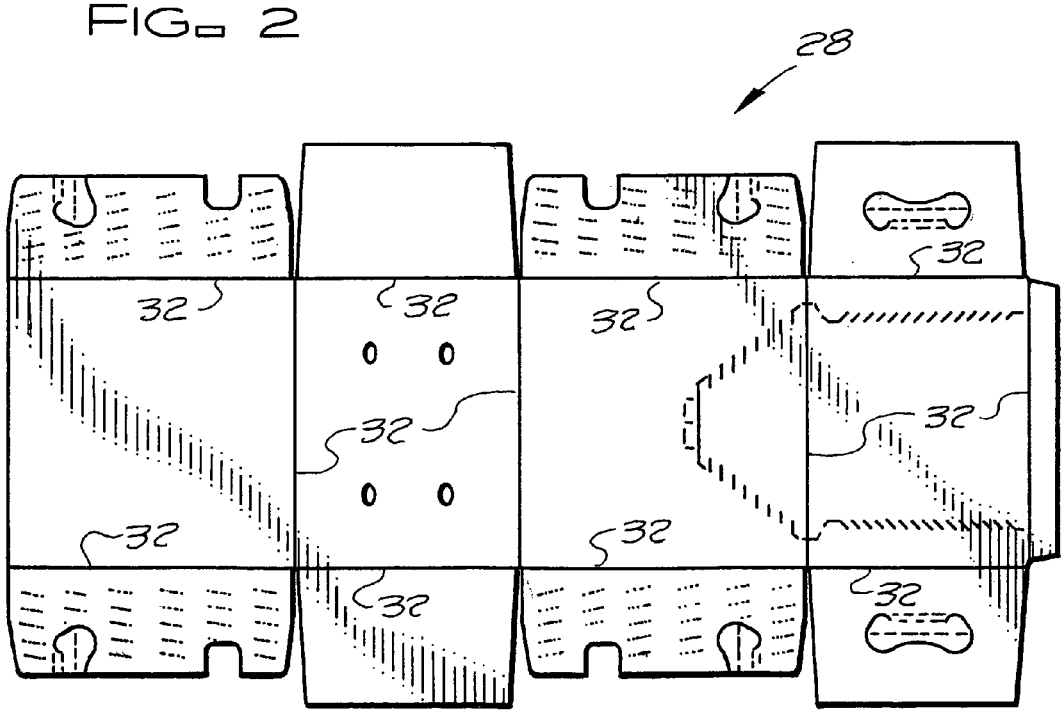
FIG. 2 is a schematic top view of a typical corrugated board carton blank made by the method of the subject invention on an in-line production line of the subject invention.

FIG. 1 is a schematic representation of a typical corrugated board 20 used in the in-line method and apparatus of the subject invention to form corrugated board carton blanks 28 such as but not limited to the carton blank shown in FIG. 2. The corrugated board 20 includes a corrugated medium 22 that forms a core of the corrugated board, an inner liner 24 and a printed outer liner 26. While other suitable corrugated medium could be used, the corrugated medium 22 forming the core of the corrugated board 20 is typically made of unbleached corrugated kraft paperboard or kraft paper-based paperboard. While other suitable liner materials could be used, the inner liner 24 of the corrugated board 20 is typically made of an unbleached kraft paper or kraft paper-based sheet material. While other suitable liner materials could be used, the printed outer liner 26 is typically made of an unbleached kraft paper or kraft paper-based paperboard. An unbleached kraft paper or kraft paper-based paperboard is typically used for the corrugated medium 22, the inner liner 24, and the printed outer liner 26 because these materials are strong, durable, and relatively inexpensive. Where the corrugated board 20 is being used to make carton blanks for cartons used as primary retail packages, the printed outer liner 26 is frequently made of a clay coated recycled paperboard or bleached fiber paperboard to enable custom printing.

The corrugated board 20 shown in FIG. 1 is a typical corrugated board made and used in the method of the subject invention to make corrugated carton blanks. However, as previously discussed in the Summary of the Invention, the liners of the corrugated board may each be made of a single paperboard or paperboard-based sheet material or laminates of two or more paperboard or paperboard-based sheet materials and a corrugated board may have two or more corrugated medium layers and additional liner(s) intermediate the corrugated medium layers, e.g. a corrugated board with two corrugated medium layers, an printed outer liner, an inner liner, and a liner intermediate the two corrugated medium layers.

The inner liner 24 has a first major surface adhesively bonded to a first major surface of the corrugated medium 22 forming the corrugated board core and a second major surface that forms the interior surfaces of cartons erected from the carton blanks 28 made by the method and/or with the apparatus of the subject invention. The printed outer liner 26 has a first major surface adhesively bonded to a second major surface of the corrugated medium 22 forming the corrugated board core and a second major surface that forms the exterior surfaces of cartons erected from the carton blanks 28 made by the method and/or with the apparatus of the subject invention.

As shown in FIG. 1, the second major surface of the printed outer liner 26 that forms the exterior surfaces of cartons erected from the carton blanks 28, not only includes printed matter and/or markings, such as but not limited to logos, trademarks, bar codes, instructions, and other printed matter relating to the contents of the carton and/or the manufacturer of the carton or its contents, but also includes a series of registration marks 30 (only one of which is shown). The series of registration marks 30 are used with the sensor and control system of the subject invention to assure that the sets of creases and sets of cuts formed in the corrugated board 20 by the method and/or with the apparatus of the subject invention are properly located relative to each other and the printed matter and/or markings to form the carton blanks with the sets of fold lines, sets of cuts, and printed matter and/or markings property located on the carton blanks. The series of registration marks 30 are printed on the second major surface of the printed outer liner at preselected set intervals, e.g. intervals that allow one of the registration marks 30 to be detected by the sensor and control system for each revolution of the rotary dies of the creasing and cutting station.

The corrugated board carton blank 28 shown in FIG. 2 is a typical carton blank that may be made by the method and with the apparatus of the subject invention, such as but not limited to the corrugated board carton blanks used in the beer industry to form the beverage cartons that contain twelve-twelve ounce or twenty four-twelve ounce bottles of beer. In the corrugated board carton blank 28 of FIG. 2, lines 32 represent fold lines of the carton blank and the remaining lines, including the lines representing the peripheral edges of the carton blank, are cut lines.

The corrugated board 20 has a width substantially equal to but greater than the length of the corrugated board carton blanks 28 being made from the corrugated board (e.g. for a carton blank about 40 inches long the double-faced corrugated board 20 would be about 45 inches wide). As shown in FIG. 2, the length of the carton blank 28 extends from the left peripheral edge to the right peripheral edge of the blank.

Figure 3:
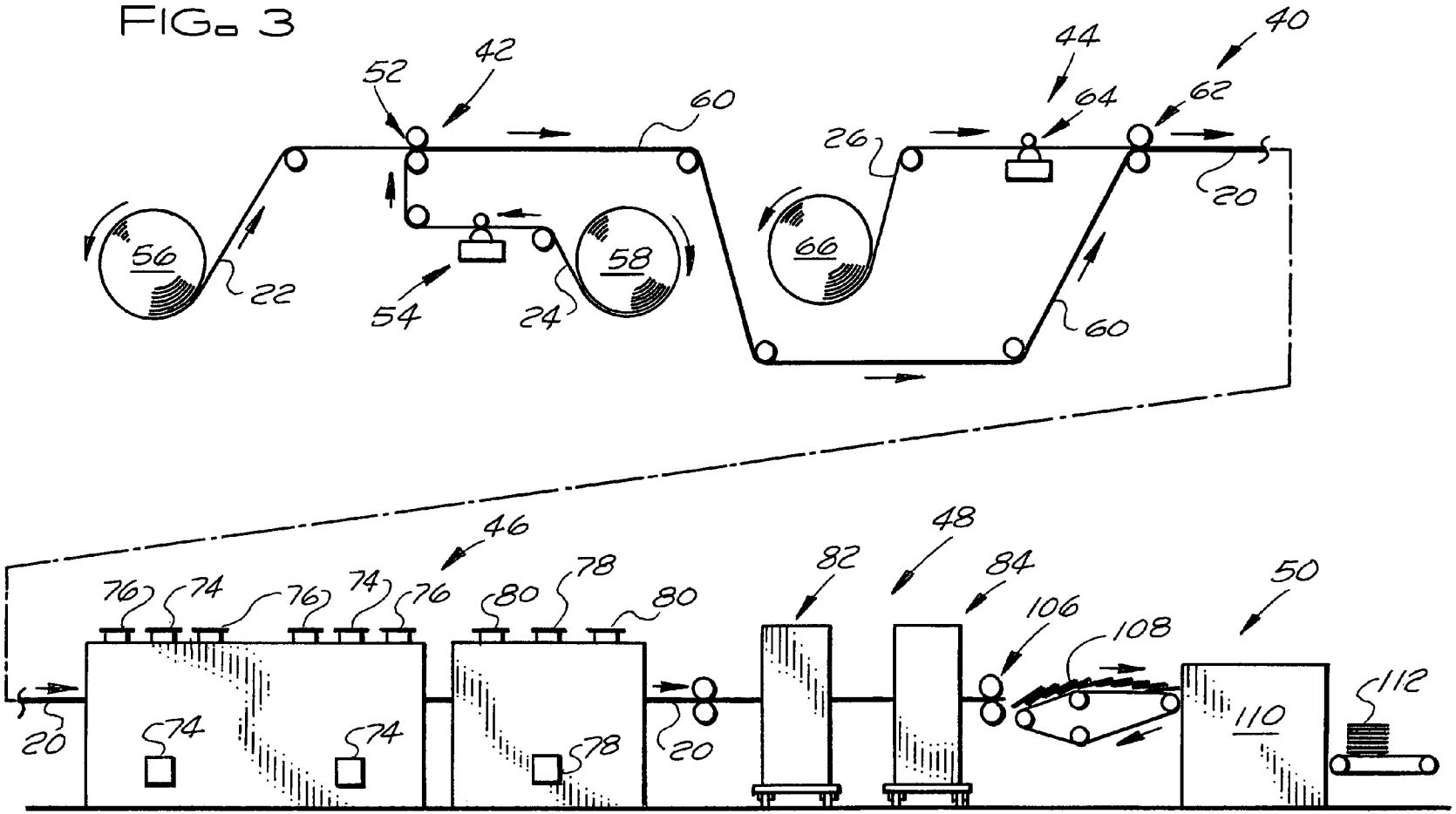
FIG. 3 is a schematic side view of an in-line production line of the subject invention that can be used with the method of the subject invention for forming corrugated board carton blanks.

FIG. 3 is a schematic side view of an in-line production line 40 of the subject invention that can be used with the method of the subject invention for forming the corrugated board carton blanks 28. The in-line production line 40 includes an inner liner laminating station 42, a printed outer liner laminating station 44, an adhesive setting station 46, a creasing, cutting, and waste stripping station 48, and a stacking station 50.

The inner liner laminating station 42 may be a conventional liner laminating station for forming a corrugated board that includes a corrugated medium 22 and an inner liner 24. The inner liner laminating station 42 includes nip rolls 52 and an adhesive applicator 54. A corrugated medium 22, such as an unbleached corrugated kraft paperboard medium, is continuously fed through the nip rolls 52 of the inner liner laminating station 42 from a supply of the corrugated medium represented by the supply roll 56. The corrugated medium 22 passes through the in-line production line 40 with the corrugations of the corrugated medium 22 extending perpendicular to the direction of travel of the corrugated medium and the direction of travel of the corrugated board formed in the production line that includes the corrugated medium 22 as its core. An inner liner 24, such as an unbleached kraft paperboard, is continuously fed into the inner liner laminating station 42 from a supply of the inner liner represented by the supply roll 58. As the inner liner 24 is fed through the inner liner laminating station 42, an adhesive is applied to the first major surface of the inner liner 24 by the adhesive applicator 54 before the inner liner passes between the nip rolls 52. While the adhesive is shown being applied by a roll coater, the adhesive could be applied by other means such as but not limited to spray application. The adhesive typically used in the method of the subject invention to bond the inner liner 24 to the corrugated medium 22 may be a conventional cold applied adhesive commonly used in the industry. However, it is contemplated starch or quick setting adhesives, such as but not limited to hot melt adhesives, might be used in the method of the subject invention. As the corrugated medium 22 and the inner liner 24 pass between the nip rolls 52, the corrugated medium 22 and the adhesive coated surface of the inner liner 24 are pressed and bonded together to form a laminate which is the corrugated board 60.

The printed outer liner laminating station 44 may be a conventional printed outer liner laminating station for laminating a printed outer liner onto the corrugated medium 22 of the corrugated board 60 and includes nip rolls 62 and an adhesive applicator 64. The corrugated board 60 is continuously fed from the inner liner laminating station 44 through the nip rolls 62 of the printed outer liner laminating station 44. A printed outer liner 26, such as day coated recycled kraft paperboard, is continuously fed into the printed outer liner laminating station 44 from a supply of the printed outer liner represented by the supply roll 66. As the printed outer liner 26 is fed through the printed outer liner laminating station, an adhesive is applied to the first major surface of the printed outer liner by the adhesive applicator 64 before the printed outer liner passes between the nip rolls 62. While the adhesive is shown being applied by a roll coater, the adhesive could be applied by other means such as but not limited to spray application. The adhesive used in the method of the subject invention to bond the printed outer liner 26 to the corrugated medium 22 may be a conventional cold applied adhesive commonly used in the industry. However, it is contemplated that starch and quick setting adhesives, such as hot melt adhesives, might also be used in the method of the subject invention. As the corrugated board 60 and the printed outer liner 26 pass between the nip rolls 62, the corrugated board 60 and the adhesive coated surface of the printed outer liner 26 are pressed and bonded together to form a laminate which is the corrugated board 20.

From the printed outer liner laminating station 44, the corrugated board 20 is passed through the adhesive setting station 46 and the creasing, cutting, and scrap removal station 48. If the corrugated board carton blanks 28 are to process well in the machinery used to erect the blanks into cartons, the corrugated board carton blanks 28 made from the corrugated board 20 in the method of the subject invention can not be bowed, but must be planar (flat) or at least substantially planar (flat) with no appreciable bow. Accordingly, as the corrugated board 20 is passed through the adhesive setting station 46 and the creasing, cutting and scrap removal station 48 to form the corrugated board carton blanks 28, the corrugated board 20 is not bent or flexed to the extent that the corrugated board will be other than planer or substantially planar as the corrugated board is made into the carton blanks 28.

In the adhesive setting station 46, the corrugated board 20 is passed through one or more ovens 70 and when needed, may also be passed through a cooling chamber 72. Preferably, the path of the corrugated board 20 through the ovens 70 and, when used, the cooling chamber 72 is in a straight line or single plane, e.g. a horizontal plane as shown in FIG. 3, or a substantially straight line or single plane so that the corrugated board 20 is retained in a planar state or a substantially planar state and does not become bowed. In the oven(s) 70 and when used, the cooling chamber 72, the adhesive bonding the corrugated medium 22 and the inner and printed outer liners 24 and 26 of the corrugated board 20 together is heated and in some applications subsequently cooled to set (cure) or sufficiently set (cure) the adhesive to provide the corrugated board 20 with the integrity required to wind the creasing, cutting and scrap removal operation in the creasing, cutting and scrap removal station 48 without a degradation of the corrugated board 20, such as but not limited to a separation of the liners 24 and/or 26 from or a movement of the liners 24 and/or 26 relative to the corrugated medium 22 that forms the core of corrugated board 20. As shown in the FIG. 3, the oven(s) have hot air inlets 74 and exhaust outlets 76 and the cooling chamber 72 has cool air inlets 78 and exhaust outlets 80. While the adhesive setting station 46 is shown using hot and cool air or gases to heat or heat and cool and set the adhesive, it is contemplated that the adhesive could also be set or cured by other sources such as but not limited to an infrared, microwave, ultraviolet (UV), electron beam (EB) heat and/or adhesive curing source. The adhesive setting temperatures within the oven(s) are sufficient to set or sufficiently set the adhesive bonding the liners 24 and 26 to the corrugated medium core 22 during the passage of the corrugated board 20 through the ovens without degrading the corrugated board 20 and especially, without degrading the appearance or physical properties of the printed outer liner 26.

After the corrugated board 20 exits the adhesive setting station 46, the corrugated board 20 is introduced into the creasing, cutting, and scrap removal station 48, which completes the formation of the corrugated board carton blanks 28 from the corrugated board 20. Preferably, the path of the corrugated board 20 through the creasing, cutting, and scrap removal station 48 continues in the single plane, e.g. the horizontal plane as shown in FIG. 3, or a substantially single plane so that the corrugated board is retained in a planar state or a substantially planar state and does not become bowed. Accordingly, the creasing, cutting and scrap removal station 48 does not include a conventional web accumulator where a web is wrapped about take-up rolls such as those normally used in continuous in-line die cutting operations.

Figure 4:
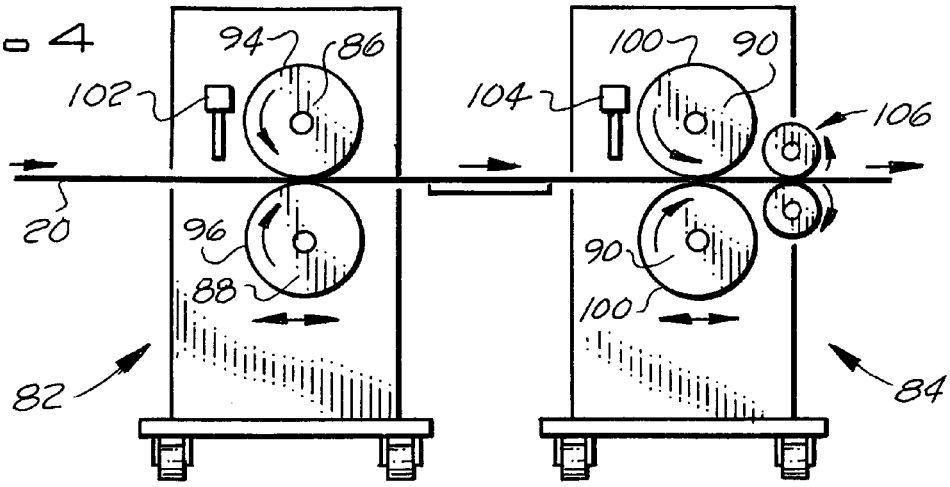
FIG. 4 is a schematic vertical cross section, on a larger scale than FIG. 3, through the die rolls of the rotary die assemblies of the creasing and cutting station of the production line of FIG. 3.

As shown in FIGS. 3 and 4, in the creasing, cutting, and scrap removal station 48, the corrugated board 20 passes through a rotary creasing die assembly 82 and a rotary cutting die and scrap removal assembly 84 that is located downstream of the rotary creasing die assembly. As the corrugated board 20 passes through the creasing, cutting, and scrap removal station 48, the corrugated board 20 is maintained in proper lateral alignment with the rotary dies of the creasing, cutting, and scrap removal station 48. The rotary creasing die assembly 82 includes a blade roll 86 and an anvil roll 88 and the rotary cutting die and scrap removal assembly 84 includes a pair of blade rolls 90 or a blade roll and an anvil roll.

Figure 5:
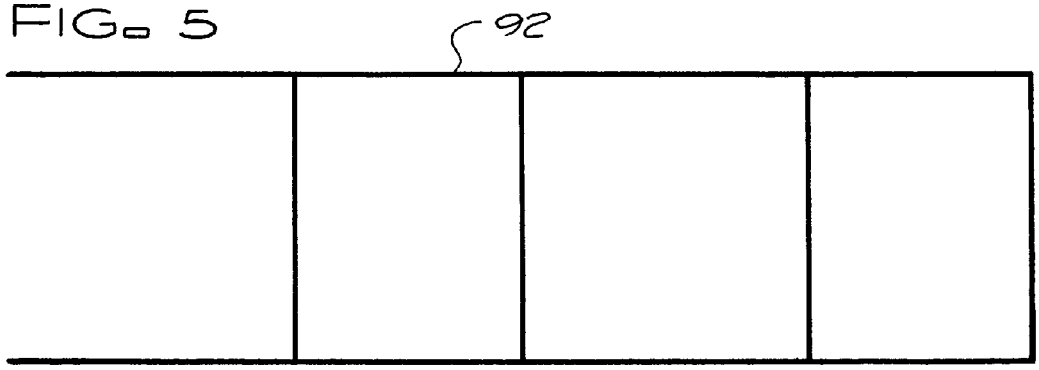
FIG. 5 is a schematic view of the creasing die layout for the rotary creasing die of the creasing and cutting station of the apparatus of the subject invention that forms crease lines in corrugated board being processed into the corrugated board carton blank of FIG. 2 in accordance with the method of the subject invention.

The blade roll 86 of the rotary creasing die assembly 82 has creasing blades 92 on its cylindrical surface 94 that are laid out in a pattern such as that shown in FIG. 5 along the length of the blade roll 86 and perpendicular to the direction of travel of the corrugated board through the rotary creasing die 82. The pattern of creasing blades 92 may be repeated a plurality of times around the circumference of cylindrical surface of the blade roll 86. The cylindrical surface 96 of the anvil roll 88 of the rotary creasing assembly 82 has grooves therein that are laid out in the same pattern as that of the creasing blades 92, along the length of the anvil roll 88 and perpendicular to the direction of travel of the corrugated board through rotary creasing die 82. The number of groove patterns in the cylindrical surface 96 of the anvil roll 88 equals the number of creasing blade patterns on the blade roll 86 and the grooves in the cylindrical surface 96 of the anvil roll 88 cooperate with the creasing blades 92 on the cylindrical surface 94 of the blade roll 86 to form creases in the corrugated board 20 that conform to the creasing blade pattern and become the fold lines in the carton blanks 28. The creasing edges of the creasing blades 92 are sufficiently blunt to form the creases in the corrugated board 20 without cutting the corrugated board.

Figure 6:
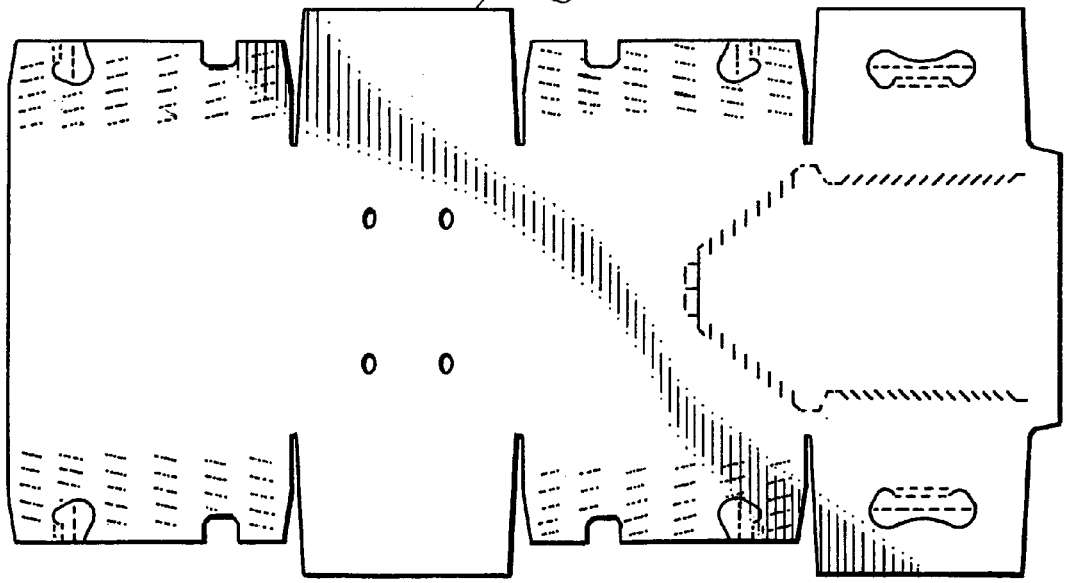
FIG. 6 is a schematic view of the cutting die layout for the rotary cutting die of the creasing and cutting station of the apparatus of the subject invention that forms cuts in corrugated board being processed into the corrugated board carton blank of FIG. 2 in accordance with the method of the subject invention.

Preferably, the blade rolls 90 of the rotary cutting die assembly 84 each have cutting blades 98 on their cylindrical surfaces 100 that are laid out in a pattern such as that shown in FIG. 6 along the length of the blade rolls 90 and perpendicular to the direction of travel of the corrugated board through the rotary cutting die 84. The pattern of cutting blades 98 may be repeated a plurality of times around the circumferences of cylindrical surfaces of the blade rolls 90. The cutting blades 98 on the cylindrical surfaces 100 of the blade rolls 90 cooperate with each other to form cuts in the corrugated board 20 that conform to the cutting blade pattern, cause the removal of scrap from the cut corrugated board to complete the formation of the carton blanks 28. The scrap (e.g. edge trim) cut from the corrugated board remains on die roll and then is peeled off of the die roll as the die roll continues its rotation by conventional techniques. Preferably, the cutting edges of the cutting blades 98 on the two blade rolls 90 do not make contact with each other but come sufficiently dose to each other to cause the remaining corrugated board material between the cutting blades to separate along the cutting edges to form the cuts in the corrugated board 20 that define the edges, cutouts, etc. in the carton blanks 28.

While the preferred cutting die and scrap removal assembly 84 includes two blade rolls 90, it is contemplated that the cutting die and scrap removal assembly 84 could include a blade roll with one or more cutting blade patterns such as that shown in FIG. 6 and an anvil roll to cooperate with the cutting blades of the blade roll to cut the corrugated board 20 and complete the formation of the carton blanks 28. Preferably, the cutting edges of the cutting blades on the blade roll would not make contact with cylindrical anvil surface but would come sufficiently dose to the anvil surface to cause the remaining corrugated board material between the cutting blades and the anvil surface to separate along the cutting edges to form the cuts in the corrugated board 20 that define the edges, cutouts, etc. in the carton blanks 28.

It is also contemplated that the creasing, cutting, and scrap removal station 48 could include only a single creasing and cutting die and scrap removal assembly rather than the creasing die assembly 82 and the cutting die and scrap removal assembly 84. However, it is preferred to use of a creasing die assembly 82 and a separate cutting die and scrap removal assembly 84. As schematically shown in FIG. 4, the creasing die assembly 82 and the cutting die and scrap removal assembly 84 are each mounted on rollers so that the creasing die assembly 82 and the cutting die and scrap removal assembly 84 can be removed and inserted into the production line independently of each other. The service life of the rotary creasing dies 86 and 88 of the creasing die assembly 82 is about four times the service life of the rotary cutting dies 90 of the cutting die and scrap removal assembly 84; the rotary cutting dies 90 of the cutting die and scrap removal assembly 84 have to be resharpened numerous times during their service life while the rotary creasing dies 86 and 88 of the creasing die assembly 82 do not require this type of maintenance; and the rotary cutting dies 90 of the cutting die and scrap removal assembly 84 are significantly more expensive than the rotary creasing dies 86 and 88 of the creasing die assembly 82. In addition, the blade patterns for both sets of rotary dies are simplified by having a creasing die assembly 82 and a separate cutting die and scrap removal assembly 84. By having separate creasing die and cutting die assemblies, the die assemblies 82 and 84 can be independently removed from and inserted into the production line when one of the die assemblies needs maintenance, replacement, or a mechanical problem arises while the other die assembly remains in place. This simplifies these tasks and can increase the efficiency of the production line.

While it is preferred to have the creasing operations performed solely by the rotary creasing dies 86 and 88 of the creasing die assembly 82 and the cutting operations performed solely by the rotary cutting dies 90 of the cutting die and scrap removal assembly 84, it is contemplated that for certain applications the first die assembly 82 and/or the second die assembly 84 could be modified so that the rotary dies 86 and 88 of the first die assembly 82 and/or the rotary dies 90 of the second die assembly 84 perform both creasing and cutting operations. For example, the rotary dies 86 and 88 of the die assembly 82 could perform the creasing operations and some of the cutting operations while the rotary cutting dies 90 of the cutting die scrap removal assembly 84 perform the remainder of the cutting operations.

As discussed above the outer major surface of the printed outer liner 26 of the corrugated board 20 has printed matter and/or markings thereon such as but not limited to logos, trademarks, instructions, etc. and a series of registration marks 30 for cooperating with a sensor and control system to properly register the printed matter and/or markings on the outer major surface of the printed outer liner 26 with the creasing and cutting operations in the creasing, cutting and scrap removal station 48 so that the sets of fold lines, the sets of cuts and the printed matter and/or other markings are properly located on the carton blanks 28. Preferably, the series of registration marks on the outer major surface of the printed outer liner 26 are spaced relative to each other along the length of the corrugated board 20 so that the registration of the printed matter and/or other markings on the printed outer liner 26 with the creasing and cutting operations of the creasing, cutting and scrap removal station 48 can be monitored once for each revolution of the rotary creasing dies 86, 88 and cutting dies 90 of the creasing, cutting, and scrap removal station 48. In this way the proper registration of the printed matter and/or other markings on the printed outer liner 26 with the creasing and cutting operations to assure a proper location of the creases, cuts and printed matter and/or other markings on the carton blanks 28 can be quickly attained on startup and maintained throughout the production run.

As the corrugated board 20 passes through the creasing, cutting, and scrap removal station 48, the locations of the registration marks 30 on the outer major surface of the printed outer liner 26 are detected by sensors 102 and 104 of a control system that controls the locations of the rotary creasing dies 86 and 88 of the creasing die assembly 82 and the rotary cutting dies 90 of the rotary cutting die and scarp removal assembly 84. The detected locations of the registration marks 30 are compared by the control system to an optimum location for the registration marks 30 to coordinate the formation of the creases and cuts in the double-faced corrugated board 20 with the printed matter and/or markings on the printed outer liner 26 to optimize the locations of the sets of fold lines in the carton blanks being formed, the sets of cuts in and defining the shape of the carton blanks being formed, and the printed matter and/or other markings on the carton blanks being formed.

When the registration marks 30 on the printed outer liner 26 detected by the sensor 102 associated with the creasing die assembly 82 are at the optimum location or are within a maximum tolerance (e.g. a tolerance of +/−1 mm) of the optimum location for coordinating the creasing operations with the printed matter and/or other markings on the printed outer liner 26, the location of the rotary creasing dies 86 and 88 remains unchanged. Should the registration marks 30 on the printed outer liner 26 be detected either upstream or downstream of the optimum location, the rotary creasing dies 86 and 88 of the creasing die assembly 82 are moved upstream or downstream a distance required to bring the detected locations of the registration marks 30 back within the tolerance.

When the registration marks 30 on the printed outer liner 26 detected by the sensor 104 associated with the cutting die assembly 84 are at the optimum location or are within a maximum tolerance (e.g. a tolerance of +/−1 mm) of the optimum location for coordinating the cutting operations with the printed matter and/or other markings on the printed outer liner 26, the location of the rotary cutting dies 90 remains unchanged. Should the registration marks 30 on the printed outer liner 26 be detected either upstream or downstream of the optimum location, the rotary cutting dies 90 of the cutting die assembly 84 are moved upstream or downstream a distance required to bring the detected locations of the registration marks 30 back within the tolerance.

Thus, the creasing and cutting operations in the creasing, cutting and scrap removal station 48 are controlled, according to the detected locations of the registration marks 30 relative to the optimum location for the registration marks, to properly register the printed matter and/or other markings on the outer major surface of the printed outer liner 26 with the creasing and cutting operations in the creasing, cutting, and scrap removal station 48 so that the sets of fold lines, the sets of cuts, and the printed matter and/or other markings are properly located on the carton blanks 28. The sensor and control system may be a conventional control system with conventional sensors 102 and 104, such as but not limited to optical scanners, for sensing the locations of the registration marks 30 on the facing 26. The control system can actuate servomotors to adjust or move the rotary creasing dies 86 and 88 of the creasing die assembly 82 and the rotary cutting dies 90 of the rotary cutting die and scrap removal assembly 84 in small upstream or downstream increments to properly coordinate the creasing and cutting operations with the printed matter and/or other markings on the printed outer liner 26.

After the corrugated board 20 has been cut by the rotary cutting dies 90 in the cutting die and scrap removal assembly 84, the trim and other scrap are stripped or removed by conventional techniques from the carton blanks 28 thus formed and the carton blanks are successively gripped by the speedup rolls 160. The trailing edges of the carton blanks 28 are not completely severed from the corrugated board 20 by the rotary cutting dies 90. There are nips of material left along the trailing edges of each carton blank 28 by the rotary cutting dies that connect the carton blank 28 to the corrugated board from which the succeeding carton blank 28 is being formed. As each carton blank 28 is gripped by the speedup rolls 160, the carton blank 28 is pulled from the rotary cutting die assembly 84 by the speedup rolls 160, is separated from the corrugated board being formed into the next succeeding carton blank by pulling apart the nips, and is ejected from the rotary cutting die assembly 84 into the stacking station 50 by speedup rolls 106. Each ejected carton blank 28 successively lands on and overlaps a previous carton blank ejected onto a "shingling" conveyor 108 of the stacking station 50. The carton blanks 28 are conveyed by the shingling conveyor 108 into a conventional carton stacker 110 where the carton blanks 28 are formed into stacks 112 of carton blanks and removed from the production line 40.

Figure 7:
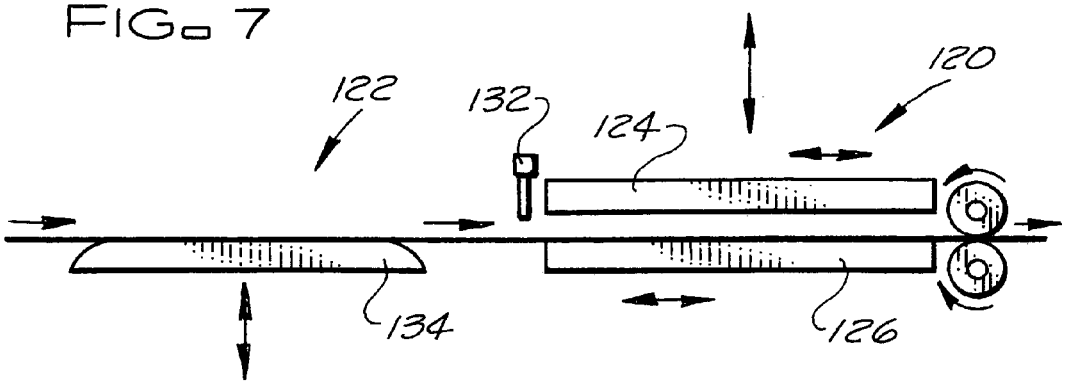
FIGS. 7 and 8 are schematic side views, on a larger scale than FIG. 3, of a flat bed die and corrugated board deflection assembly that may be utilized in the creasing and cutting station of the apparatus of the subject invention in place of the rotary creasing and cutting dies of FIGS. 3 and 4.
Figure 8:
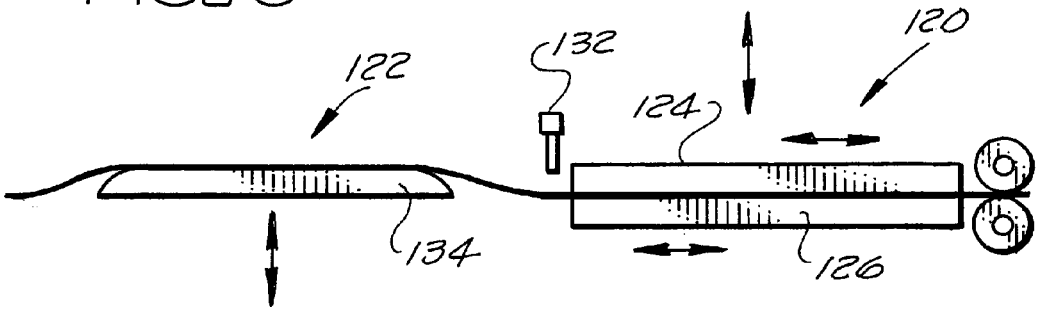
Figure 9:
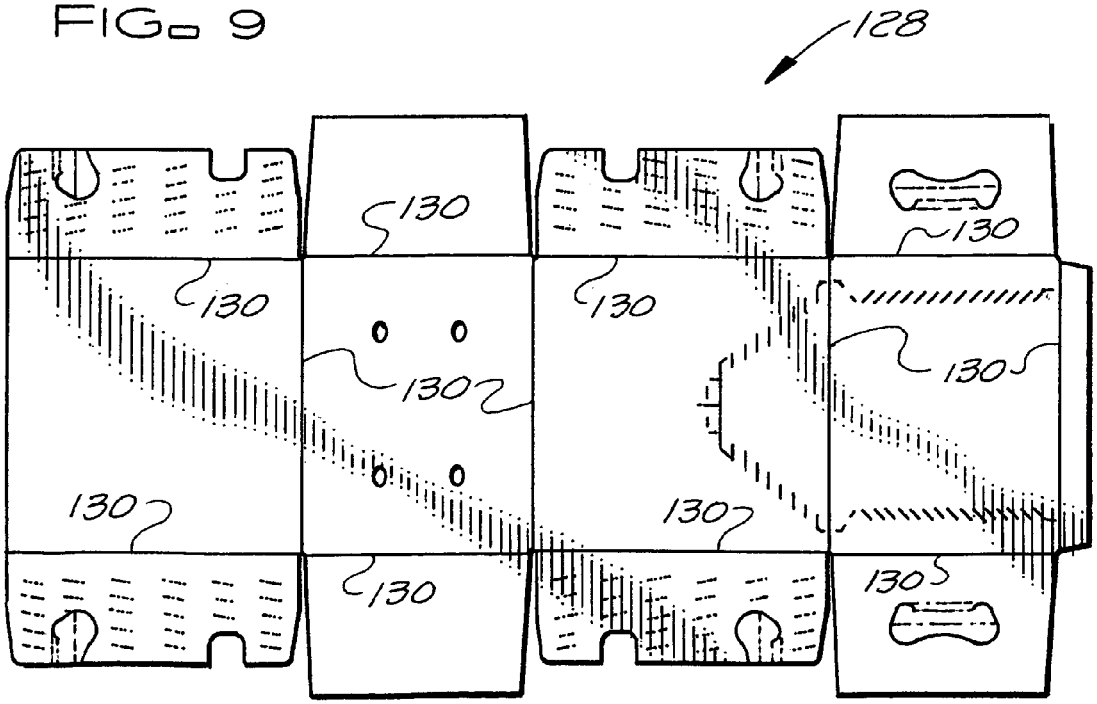
FIG. 9 is a schematic plan view of the creasing and cutting layout for the flat bed die of FIGS. 7 and 8 that forms crease lines and cuts in corrugated board being processed into the corrugated board carton blank of FIG. 2 in accordance with the method of the subject invention.

FIGS. 7 and 8 are schematic side views of a flat bed die assembly 120 and corrugated board deflection assembly 122 that may be utilized in the creasing, cutting and scrap removal station 48 of the production line 40 in place of the rotary creasing and cutting die assemblies 82 and 84. The flat bed die assembly 120 includes a reciprocating flat creasing and cutting blade die platen 124 and a non-reciprocating flat anvil platen or anvil and cutting blade platen 126. The creasing and cutting die platen 124 includes one or more patterns 128 of creasing blades and cutting blades on its lower major surface that, when producing carton blanks 28, such as that shown in FIG. 2, are laid out as set forth in FIG. 9 to form carton blanks that extend lengthwise perpendicular to the direction of travel of the corrugated board 20 through the flat bed die assembly 120. The creasing blades in the pattern 128 are designated by reference numeral 130. The remaining blades in the pattern 128 are the cutting blades. The upper major surface of the anvil platen or anvil and cutting blade platen 126 may include only grooves that are laid out in the same pattern as that of the creasing blades on the lower major surface of the creasing and cutting blade die platen 124 or may include grooves that are laid out in the same pattern as the creasing blades on the lower major surface of the creasing and cutting die platen 124 and cutting blades that are laid out in the same pattern as the cutting blades on the lower major surface of the creasing and cutting die platen 124. Where the upper major surface of the anvil die platen 126 only includes grooves, the grooves cooperate with the creasing blades of the creasing and cutting die 124 to form creases in the corrugated board 20 that become the fold lines of the carton blanks and the planar surface of the anvil die platen 126 cooperates with the cutting blades of the creasing and cutting die 124 to form the cuts defining the cutouts and shape of the carton blanks being formed. Where the upper major surface of the anvil die platen 126 includes both grooves and cutting blades, the grooves cooperate with the creasing blades of the creasing and cutting die 124 to form creases in the corrugated board 20 that become the fold lines of the carton blanks being formed and the cutting blades cooperate with the cutting blades of the creasing and cutting die 124 to form cuts in the corrugated board 20 that become the cuts defining the cutouts and shape of the carton blanks being formed.

As discussed above the outer major surface of the printed outer liner 26 of the corrugated board 20 has printed matter and/or other markings thereon such as but not limited to logos, trademarks, instructions, etc. and a series of registration marks 30 for cooperating with a sensor and control system to property register the printed matter and/or other markings on the second major surface of the facing 26 with the creasing and cutting operations in the creasing, cutting, and scrap removal station 48 so that the sets of fold lines, the sets of cuts and the printed matter and/or other markings are properly located on the carton blanks 28. Preferably, the series of registration marks on the outer major surface of the printed outer liner 26 are spaced relative to each other along the length of the corrugated board 20 so that the registration of the printed matter and/or other markings on the facing 26 with the creasing and cutting operations of the creasing, cutting, and scrap removal station 48 can be monitored every time the creasing and cutting blade die 124 reciprocates through its stamping cycle. In this way the proper registration of the printed matter and/or other markings on the printed outer liner 26 with the creasing and cutting operations to assure a proper location of the creases, cuts and printed matter and/or other markings on the carton blanks 28 can be quickly attained on start-up and maintained throughout the production run.

As the corrugated board 20 passes through the creasing, cutting, and scrap removal station 48, the locations of the registration marks 30 on the outer major surface of the printed outer liner 26 are detected by a sensor 132 of a control system that controls the locations of the creasing and cutting blade die platen 124 and the anvil or anvil and cutting blade die platen 126 of the creasing and cutting die assembly 120. The detected locations of the registration marks 30 are compared by the control system to an optimum location for the registration marks 30 to coordinate the formation of the creases and cuts in the corrugated board 20 with the printed matter and/or other markings on the facing 26 to optimize the locations of the sets of fold lines in the carton blanks being formed, the sets of cuts in and defining the shape of the carton blanks being formed, and the printed matter and/or other markings on the carton blanks being formed.

When the registration marks 30 on the printed outer liner 26 detected by the sensor 132 associated with the creasing and cutting die assembly 120 are at the optimum location or are within a maximum tolerance (e.g. a tolerance of +/−1 mm) of the optimum location for coordinating the creasing operations with the printed matter and/or other markings on the facing 26, the locations of the creasing and cutting blade die platen 124 and the anvil platen or anvil and cutting blade platen 126 remain unchanged. Should the registration marks 30 on the printed outer liner 26 be detected either upstream or downstream of the optimum location, the creasing and cutting blade die platen 124 and the anvil platen or anvil and cutting blade platen 126 die assembly 82 are moved upstream or downstream a distance required to bring the detected locations of the registration marks 30 back within the tolerance.

Thus, the creasing and cutting operations in the creasing, cutting, and scrap removal station 48 are controlled, according to the detected locations of the registration marks 30 relative to the optimum location for the registration marks, to properly register the printed matter and/or other markings on the outer major surface of the printed outer liner 26 with the creasing and cutting operations in the creasing, cutting, and scrap removal station 48 so that the sets of fold lines, the sets of cuts, and the printed matter and/or other markings are properly located on the carton blanks 28. The sensor and control system may be a conventional control system with a conventional sensor 132, such as but not limited to an optical scanner, for sensing the locations of the registration marks 30 on the printed outer liner 26. The control system can actuate servomotors to adjust or move the creasing and cutting blade die platen 124 and the anvil platen or anvil and cutting blade platen 126 in small upstream or downstream increments to properly coordinate the creasing and cutting operations with the printed matter and/or other markings on the printed outer liner 26.

The corrugated board 20 must be stationary while the blades of the creasing and cutting die platen 124 are passing down through and back up through the corrugated board 20 to form the carton blank 28 during the stamping portion of its operating cycle. The corrugated board deflection assembly 122 engages the corrugated board 20 upstream of the flat bed die assembly 120 to cause the corrugated board 20 to be stationary in the flat bed die assembly 120 during each stamping portion of the operating cycle for the creasing and cutting die platen 124. The corrugated board deflection assembly 122 includes a reciprocating platen 134 that reciprocates between a first retracted position shown in FIG. 7 where the corrugated board 20 passes over the upper major surface of the platen in a straight line or planar path from the adhesive setting station 46 to the flatbed die assembly 120 and a second extended position shown in FIG. 8 where the upper major surface of the platen 134 engages, deflects, and raises the corrugated board 20 out of the planar path it normally follows between the adhesive setting station 46 and the flatbed die assembly 120. The reciprocating movements of the platen 134 and the creasing and cutting blade die platen 124 of the flatbed die assembly 120 are coordinated so that the platen 134 is moving upward to its extended position while the creasing and cutting blade die 124 of the flatbed die assembly 120 is passing through the stamping portion of its operating cycle to momentarily stop the movement of the corrugated board 20 through the flatbed die assembly and returns to its retracted position for the remainder of the operating cycle of the creasing and cutting blade die platen 124. The deflection of the corrugated board 20 from its normal straight line or planar path by the platen 134 is regulated so that the corrugated board 20 immediately returns to its planar state or a substantially planar state after it passes over the extended platen 134 and does not become bowed.

After the corrugated board 20 has been creased and cut by the flatbed die assembly 120, the trim and other scrap are stripped or removed by conventional means from the carton blanks 28 thus formed and the carton blanks are successively gripped by the speedup rolls 136. The trailing edges of the carton blanks 28 are not completely severed from the corrugated board 20 by the flatbed die assembly 120. There are nips of material left along the trailing edges of each carton blank 28 by the cutting blades of the flatbed die assembly that connect the carton blank 28 to the corrugated board from which the succeeding carton blank 28 is being formed. As each carton blank 28 is gripped by the speedup rolls 136, the carton blank 28 is pulled from the flatbed die assembly 120 by the speedup rolls 136, is separated from the corrugated board being formed into the next succeeding carton blank by pulling apart the nips, and is ejected from the flatbed die assembly 120 into the stacking station 50 by speedup rolls 136. Each ejected carton blank 28 successively lands on and overlaps a previous carton blank ejected onto a "shingling" conveyor 108 of the stacking station 50. The carton blanks 28 are conveyed by the shingling conveyor 108 into a conventional carton stacker 110 where the carton blanks 28 are formed into stacks 112 of carton blanks and removed from the production line 40.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto. The "ASTRACT" is provided to comply with 37 C.F.R. §1.72(b), which requires an abstract that will allow the reader to quickly ascertain the nature and gist of the technical disclosure, and with the understanding that it will not be used to interpret or limit the scope or meaning of the claims.

What is claimed is:

1. An apparatus for making a corrugated board and carton blanks from the corrugated board in a continuous in-line manufacturing process, comprising:

means for continuously feeding a first corrugated board comprising a corrugated medium and an inner liner into a laminating station; the inner liner having a first major surface bonded to the corrugated medium and a second major surface that forms interior surfaces of cartons made from carton blanks made in the in-line manufacturing process;

means for continuously feeding a printed outer liner into the laminating station; the printed outer liner having a first major surface to be bonded to the first corrugated board and a second major surface with printed matter and/or other markings thereon that forms exterior surfaces of cartons made from the carton blanks made in the in-line manufacturing process;

means for continuously bonding the first major surface of the printed outer liner to the corrugated medium of the first corrugated board in the laminating station with an adhesive to form a second corrugated board comprising the corrugated medium, the inner liner and the printed outer liner;

means for continuously feeding the second corrugated board, with the adhesive sufficiently set to maintain the printed outer liner in a fixed position relative to a remainder of the second corrugated board, through a creasing and cutting station for repeatedly locating and forming a set of longitudinally and transversely extending fold lines and a set of longitudinally and transversely extending cuts in the second corrugated board to successively form carton blanks from the second corrugated board;

creasing and cutting means in the creasing and cuffing station for repeatedly creasing and cutting the second corrugated board as the second corrugated board is fed through the creasing and cuffing station by repeatedly locating and forming the set of longitudinally and transversely extending fold lines and the set of longitudinally and transversely extending cuts in the second corrugated board while maintaining the second corrugated board in a sufficiently planar state to successively form carton blanks from the second corrugated board that are substantially planer and unfolded to facilitate a later processing of the carton blanks; the creasing and cuffing means comprising a rotary creasing die for repeatedly forming the set of fold lines in the second corrugated board and a separate rotary cutting die for repeatedly forming the set of cuts in the second corrugated board; and the creasing and cutting means including sensor and control means for sensing and coordinating the repeated location and formation of the set of fold lines and the set of cuts in the second corrugated board relative to each other and the printed matter or other markings on the printed outer liner by moving the rotary creasing die and/or the rotary cutting die in the direction of travel of the second corrugated board in response to sensed conditions to maintain a proper registration of the printed matter and/or other markings on the second major surface of the printed outer liner with the creasing and cutting operations whereby the printed matter and/or other markings on the printed outer liner are properly located on the carton blanks relative to the sets of fold lines and cuts; and a take off station and means for continuously feeding the carton blanks from the creasing and cutting station into the take off station for removal from the in-line manufacturing process while maintaining the carton blanks in a sufficiently planar state to cause the carton blanks to remain substantially planar and unfolded when delivered to the take off station to facilitate the later processing of the carton blanks wherein the blanks are folded and adhesively bonded to make cartons.

2. The apparatus for making a corrugated board and carton blanks from the corrugated board in a continuous in-line manufacturing process according to claim 1, including:

means for heating the adhesive as the second corrugated board is fed from the laminating station to the creasing and cutting station to quicken the setting of the adhesive.

3. The apparatus for making a corrugated board and carton blanks from the corrugated board in a continuous in-line manufacturing process according to claim 1, wherein:

the rotary creasing die is located upstream of the rotary cutting die.

4. The apparatus for making a corrugated board and carton blanks from the corrugated board in a continuous in-line manufacturing process according to claim 1, wherein:

the sensor and control has means for detecting the locations of a series of registration marks on the second major surface of the printed outer liner of the second corrugated board as the second corrugated board passes through the creasing and cutting station; for comparing the detected locations of the registration marks to an optimum location for the registration marks that optimizes the locations of the sets of fold lines, the sets of cuts, and the printed mailer and/or other markings on the carton blanks; and for controlling the creasing and cuffing operations of the creasing and cuffing station, according to the detected locations of the registration marks relative to the optimum location for the registration marks, to properly register the printed mailer and/or other markings on the second major surface of the printed outer liner with the creasing and cuffing operations in the creasing and cuffing station so that the sets of fold lines, the sets of cuts, and the printed mailer and/or other markings on the second major surface of the printed outer liner are properly located on the carton blanks.

5. The apparatus for making a corrugated board and carton blanks from the corrugated board in a continuous in-line manufacturing process according to claim 4, including:

means for heating the adhesive as the second corrugated board is fed from the laminating station to the creasing and cutting station to quicken the setting of the adhesive.

* * * * *